US007819763B2

(12) United States Patent
Campbell et al.

(10) Patent No.: US 7,819,763 B2
(45) Date of Patent: Oct. 26, 2010

(54) BASEBALL BATTING TRAINER

(76) Inventors: Steven S. Campbell, 820 Walker, Center, TX (US) 75935; Mathew B. Campbell, 820 Walker, Center, TX (US) 75935; Eric C. Campbell, 820 Walker, Center, TX (US) 75935

( * ) Notice: Subject to any disclaimer, the term of this patent is extended or adjusted under 35 U.S.C. 154(b) by 813 days.

(21) Appl. No.: 11/111,148

(22) Filed: Apr. 21, 2005

(65) Prior Publication Data

US 2006/0240917 A1 Oct. 26, 2006

(51) Int. Cl.
*A63B 69/00* (2006.01)

(52) U.S. Cl. ..... 473/453; 473/422

(58) Field of Classification Search ..... 473/453, 473/422–425, 426–430, 454, 451, 417; 273/407; 482/109, 122; 434/247
See application file for complete search history.

(56) References Cited

U.S. PATENT DOCUMENTS 3,386,733 A * 6/1968 Russo et al. ..... 473/453
3,475,026 A * 10/1969 Cooper ..... 473/430
3,937,464 A * 2/1976 Zalewski ..... 473/428
4,451,036 A * 5/1984 Sinclair et al. ..... 473/453
4,655,452 A * 4/1987 Huerstel ..... 473/453
5,226,645 A 7/1993 Stewart
5,226,646 A 7/1993 Levatino
5,342,267 A 8/1994 Adams et al.
5,478,070 A * 12/1995 Morrison ..... 473/419
5,711,726 A * 1/1998 Powers ..... 473/453
6,435,990 B1 * 8/2002 Bradley ..... 473/453
6,461,255 B1 * 10/2002 Smith ..... 473/417
2006/0089212 A1 * 4/2006 Marchel ..... 473/422
2006/0148597 A1 * 7/2006 Pope et al. ..... 473/453

* cited by examiner

*Primary Examiner*—Mitra Aryanpour
(74) *Attorney, Agent, or Firm*—Akin Gump Strauss Hauer & Feld, LLP

(57) ABSTRACT

A system and a method is provided for improving a baseball player's batting swing. Preferably, the system can be utilized to teach a player to swing with power and with a slight upstroke to increase the chances of getting a powerful line drive hit. The system includes a post upwardly extending from a support base. Preferably, the post is adjustable to increase or decreased in height to match the size of the player utilizing the system. A channel is attached at upper portion of the post and includes a means for providing resistance, such as bristles, that protrude generally upwardly from the channel base. A second similar channel with a resistance means is mounted above and facing the first channel such that there is a gap between the two resistance means. Preferably, the channels are rotatably mounted to the post such that the angle of the path between the resistance means can be adjusted to provide a slight increase in elevation that will result in a slight upswing by the player utilizing the training system. A channel support is utilized to fix the position of the two channels relative to each other. Preferably, the channel support is shaped to guide and direct a player's swing down and through the resistance means of the channels. Preferably the channel support includes a resistance adjustment that can increase or decrease the resistance on a bat passing through the channels.

14 Claims, 1 Drawing Sheet

BASEBALL BATTING TRAINER

CROSS-REFERENCE TO RELATED APPLICATIONS

Not applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates generally to a baseball training apparatus, and more particularly to a device which can be used to improve batting skills.

2. Description of the Related Art

One of the most desirable skills for a baseball player is to be able to get a hit and get on base. Getting on base with a good hit requires various batting skills including a fundamentally sound swing, a powerful swing, and an accurate swing that will meet the trajectory of a pitched baseball.

Over time, various techniques have been used to enhance the hitting skills of baseball players. Traditionally, players have trained by repeatedly trying to hit balls thrown by pitchers or machines. Generally, coaches watching the practice would instruct the player on form and techniques in an attempt to improve the player's swing.

It has been recognized that machines can be utilized to train player's in a manner to improve their swing and therefore improve their chances of getting a hit. One example of such a machine is found in U.S. Pat. No. 5,226,546 to Stewart entitled Baseball Power Swing Trainer. The Stewart patent discloses a machine having two barriers, such as two small tires, adjustably mounted one above the other. A player swings at the gap between the tires. One premise of the Stewart patent was that a level swing was the most desirable swing for a player. As such, the Stewart patent attempted to design a device that would train a player to have a level swing.

Applicants have studied the game of baseball and concluded that a level swing is not necessarily the most advantageous technique for hitting the ball and getting on base. Applicants' non-scientific study of the game has led them to conclude that a player has about a thirty percent chance of reaching base on a fly ball, about a fifty percent chance of reaching base on a ground ball, and about a seventy percent chance of reaching base with a line drive. To hit a line drive, Applicants have found that a slight upstroke during the swing is most likely to yield a line drive hit and therefore get the player on base safely.

It would be desirable to have an apparatus that would train a player to have a fundamentally sound swing and hit a baseball using a slight upstroke as opposed to a level swing. It would also be desirable to have a training machine that increased the power of a player's swing. It would be further desirable to have a training machine that could improve the accuracy of a player's swing by matching their swing with the trajectory of a pitched ball.

BRIEF SUMMARY OF THE INVENTION

The present invention provides a system and a method for improving a baseball player's batting swing. Preferably, the system can be utilized to teach a player to swing with power and with a slight upstroke to increase the chances of getting a powerful line drive hit.

The system includes a post upwardly extending from a support base. Preferably, the post is adjustable to increase or decrease the height to match the size of the player utilizing the system or to adjust to different locations of potential pitches. A channel is attached at upper portion of the post and includes a means for providing resistance, such as bristles, that protrude generally outwardly from the channel base. A second similar channel with a similar resistance means is mounted above and facing the first channel such that there is a gap between the two resistance means. Preferably, the channels are rotatably mounted to the post such that the angle of the path between the resistance means can be adjusted to provide a slight increase in elevation through the path that will result in a slight upswing by the player utilizing the training system. A channel support is utilized to fix the position of the two channels relative to each other. Preferably, the channel support is shaped to guide and direct a player's swing down and through the resistance means of the channels. Preferably, the channel support includes a resistance adjustment that can increase or decrease the resistance on a bat passing through the channels.

The method of training a player to hit powerful line drives includes providing the baseball training apparatus discussed above. Initially, the height of the post can be adjusted to match a player's size or to a specific type of pitch. Then, the angle of the channels can be adjusted such that the path between the channels matches the projected flight path of an incoming pitch. Next, the resistance adjustment is set to the desired resistance for the player. Initially, the resistance can be set just tight enough to hold a baseball in place. A player then stands before the apparatus in a batting stance, begins to swing the bat, preferably through the channel support. Preferably, the channel support will guide the player's swing downwardly toward the path between the channels. The "sweet spot" of the bat should engage the resistance means as the bat travels through the channels where the swing is directed in a slightly upward direction.

Using the system as a batting tee and taking approximately 100 swings each day should give the player the necessary repetitions to build muscle memory needed to hit powerful line drives. When used in combination with live pitching practice, a player should grow in confidence and becomes an advanced hitter.

BRIEF DESCRIPTION OF THE SEVERAL VIEWS OF THE DRAWINGS

A better understanding of the present invention can be obtained when the following detailed description of various disclosed embodiments is considered in conjunction with the following drawing, in which.

DETAILED DESCRIPTION OF THE INVENTION

Figure 1:
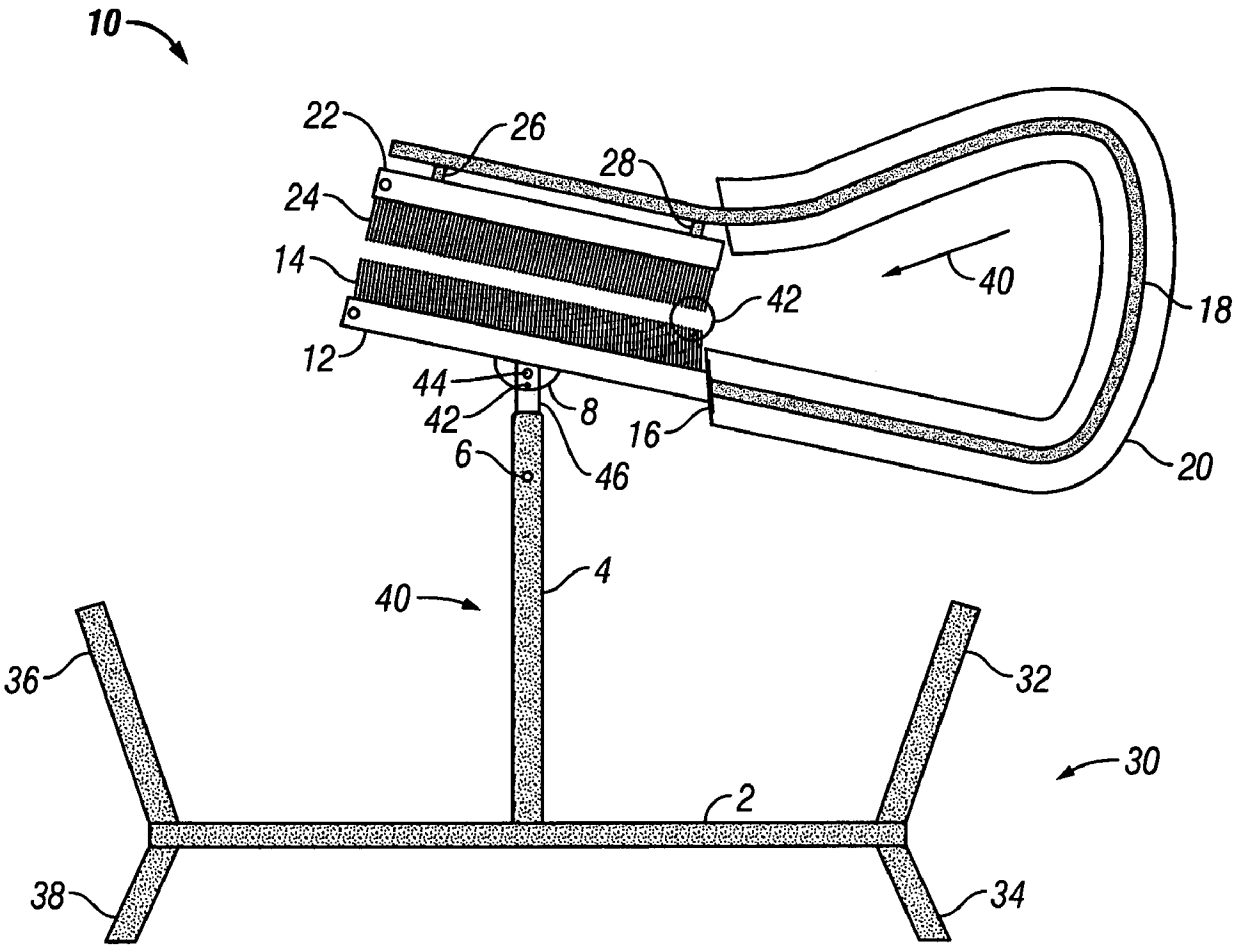
FIG. 1 is a perspective view showing an embodiment of a baseball player training apparatus.

A preferred embodiment of the present invention is a system that can be utilized to teach a player to swing with power and hit with a slight upstroke to increase the chances of getting a powerful line drive hit. The preferred system defines a path for the player's swing and provides resistance to the swing.

Generally, the preferred embodiment includes two opposing channels. A first channel 12 is an elongated channel having a resistance means 14 that protrudes outwardly from the channel base. Preferably, channel 12 comprises an elongated metal box with short rim sides. Channel 12 can be padded to protect the player's bat from incidental contact. In a most preferred embodiment, a section of flexible plastic drain pipe can be used to enclose channels 12 and 22.

Resistance means 14 is preferably removably attached inside channel 12. Resistance means 14 can comprise bristles in arranged various rows or configurations. Preferably one row of bristles are directly over and in continuous alignment with a second row of bristles. Resistance means 14 can also include foam padding, preferably three inch to four inches, covered by carpet, or other similar materials. In the most preferred embodiment, channel 12 is shaped to receive the head of a commercial push broom which acts as resistance means 14. The head of an 18" broom provides an adequate path for little leaguers. A 24" broom may be used for older players. The broom head is then bolted into channel 12. Alternatively, channel 12 and resistance means 14 can be a single integral unit.

A second channel 22 with a resistance means 24 is positioned above and opposite channel 12. Resistance means 24 of second channel 22 is placed proximate to resistance means 14 of channel 12. However, preferably, the resistance means 14 and 24 are spaced apart to define a path through which a bat may swing. Preferably, channel 22 and resistance means 24 have the same structure and materials as channel 12 and resistance means 14 and preferably are removably attached.

In the preferred embodiment, a plate 16 is attached to one end of the first channel 12. In the most preferred embodiment plate 16 is welded to channel 12. Plate 16 acts as an attachment point for a channel support 18. Preferably, channel support 18 is a length of three-quarter inch (¾") round bar. Channel support 18 is preferably shaped to provide a guide path through which a bat may swing. In the most preferred embodiment, the channel support 18 defines a swing path 40 that guides and directs a player's swing down and through the resistance means 14 and 24. Preferably, channel support 18 is padded to protect the bat from incidental contact. Most preferably, a length of three inch to four inch (3"-4") round foam padding with a hollow core is placed over the three-quarter inch (¾") round bar to provide such protection.

In a preferred embodiment, the second channel 22 is attached to an upper portion of channel support 18. Preferably, such attachment provides for a resistance adjustment that allows the second channel 22 to move closer to or further away from first channel 12. As the resistance means 14 and 24 come closer together, resistance is increased and as the channels are moved apart resistance decreases. In a most preferred embodiment, U-bolts 26 and 28 attach channel support 18 to channel 22. Preferably one U-bolt will be placed at each end of Channel 22 to lock channel 22 to channel support 18. Slight adjustments to the U-bolts can increase or decrease the amount of resistance to the player. By adjusting a lower set of nuts on U-bolts 26 and/or 28, the resistance means can be adjusted to pinch a baseball and gradually to impart resistance as the bat travels between resistance means 14 and 24.

Preferably, the system is supported by a base 30 with a support post extending substantially vertically and engaging first channel 12. Base 30 can have a variety of configurations within the scope of the invention. Preferably, base 30 is designed to allow a player to stand close enough to the system 10 to practice his swing, but yet has a wide enough footing to provide stable support to the system 10. In one embodiment, base 30 will include two pair of support legs 34 and 38, supportingly attached to a base plate or frame 2. Frame 2 can be a piece of 4" channel iron, approximately 2-3 feet long. Base 30 may optionally include support arms 32 and 36 extending outwardly from base plate 2. Optionally, the heavy rubber bases found on road construction barricade drums or similar structures may also be utilized. In a most preferred embodiment, base 30 can have a small tire at one end with handle bars at the other end to assist in moving the system on and off the field, similar to a wheelbarrow. The handles extend outwardly and rest on the ground to brace and steady the apparatus.

Preferably, a supporting post 40 is attached to base 30. In the most preferred embodiment, support post 40 extends generally vertically upward from base 30 and attaches to the bottom of channel 12. In the most preferred embodiment, support post 40 comprises an external portion 4 and an internal portion 42. Preferably, external support post 4 is a hollow tube and internal support post 42 is positioned at least partially inside external support post 4. Together, these two posts can be used to adjust the height of the system by raising or lowering internal support post 42 within support post 4.

Preferably, support post 40 includes a height adjustment 6 to fix the position of external support post 4 relative to internal support post 42. In the most preferred embodiment, height adjustment 6 comprises a pin which can be inserted through aligned holes in both support posts 4 and 42. In the most preferred embodiment, there are a series of spaced apart holes on internal support post 42 and a single hole on external support post 4 that allow a variety of height adjustments. Alternately, collars, notches, slots, and clips, or other similar structures can be used alone, or in combination to provide height adjustment. There are a number of reasons to adjust the height of the system. Initially, the system can be adjusted in height to match the size of a player. Further, the system may be adjusted in height to prepare the player for a certain type of pitch. For example, a low strike is generally favored by coaches and pitchers. Therefore, it would be helpful to train a batter to hit a low strike which is likely to be the most commonly pitched ball.

Preferably, first channel 12 is rotatably attached to the support post 40 such that the angle of channel 12 can be adjusted relative to the ground. The system certainly encompasses a swing path that is horizontal (level). Preferably, however, first channel 12 is angled upwards toward the pitcher, and therefore the swing path through the resistance means 14 and 24 is adjusted to provide a slight upstroke for the player's swing. Most preferably, the angle is adjusted to match the trajectory of incoming pitches which will allow the bat to travel directly into the path of oncoming baseballs. By estimating a pitcher's release point, a string line can be run from that point to a point at home plate approximately equal to the height of the player's knees. The angle of this system can be adjusted to match such string lines projecting the flight path of a incoming pitch. This can increase the player's chance of getting a hit.

In the most preferred embodiment, the rotatable attachment is accomplished with a metal saddle 8 which can be welded to first channel 12. Saddle 8 is then secured to support post 40 preferably with a bolt 44. Preferably, saddle 8 includes a slot through which a second bolt 46 extends and can be used to secure the system at a desired angle by tightening the bolt on a specific location in the slot.

The method of training a player to hit powerful line drive includes providing the baseball training apparatus discussed above. Initially, the height of the post can be adjusted to match a player's size or to a specific type of pitch. Then, the angle of the channels can be adjusted such that the path between the channels matches the projected flight path of an incoming pitch. Next, the resistance adjustment is set to the desired resistance for the player. Initially, the resistance can be set just tight enough to hold a baseball in place. A player then stands before the apparatus in a batting stance, begins to swing the bat, preferably through the channel support. Preferably, the channel support will guide the player's swing downwardly toward the path between the channels. The "sweet spot" of the bat should engage the resistance means as the bat travels through the channels where the swing is directed in slightly upward direction.

The foregoing disclosure and description of the invention are illustrative and explanatory thereof, and various changes in the details of the illustrated apparatus and construction and the method of operation may be made without departing from the spirit of the invention.

We claim:

1. A baseball training apparatus, comprising: a support base; a support post affixed to and extending vertically from said support base; a first channel rotably secured to an upper portion of said post; said first channel comprising a channel base and a resistance means, said resistance means extending above the channel base; a second channel comprising a channel base and a resistance means, said resistance means extending below the channel base; said second channel positioned generally above and opposite from said first channel such that the resistance means of said second channel is proximate to, but spaced apart from, the resistance means of said first channel; and a channel support attached to said first and second channels to fix the position of said channels relative to each other; said channel support defining a batting swing path leading into the resistance means;

Wherein said resistance means of said first and second channels comprise bristles.

2. The apparatus of claim 1, wherein said bristles are removably affixed in said first and second channels.

3. A baseball training apparatus, comprising: a support base; a support post affixed to and extending vertically from said support base; a first channel rotably secured to an upper portion of said post; said first channel comprising a channel base and a resistance means, said resistance means extending above the channel base; a second channel comprising a channel base and a resistance means, said resistance means extending below the channel base; said second channel positioned generally above and opposite from said first channel such that the resistance means of said second channel is proximate to, but spaced apart from, the resistance means of said first channel; and a channel support attached to said first and second channels to fix the position of said channels relative to each other; said channel support defining a batting swing path leading into the resistance means;

A resistance adjustment for adjusting a distance between the resistance means on said first channel and the resistance means on said second channels, thereby adjusting batting resistance.

4. The apparatus of claim 3, wherein said resistance adjustment comprises at least one U-bolt connecting said second channel to said channel support that can be raised or lowered to adjust the distance between the resistance means of said first and second channels.

5. A baseball training apparatus, comprising;

a support base;

an external post extending vertically upward from said support base; said external post comprising a hollow tube;

an internal post, said internal post having a bottom portion enclosed within said external post and a top portion extending vertically above said external post;

a height adjustment, operably attached to said internal and external posts, for adjustably fixing the position of the internal post relative to the external post;

an angle adjustment saddle rotatably attached to the top portion of said internal post;

a first channel attached to said angle adjustment saddle, said first channel comprising a channel base and bristles, said bristles extending outwardly from said channel base;

a second channel comprising a channel base and bristles, said bristles extending outwardly from said channel base, said second channel being positioned generally above and opposite from said first channel such that distal ends of the bristles of said second channel are proximate to, but spaced apart from, distal ends of the bristles of said first channel; and a channel support attached to said first and second channel to fix the position of said channels relative to each other.

6. The apparatus of claim 5, further comprising a resistance adjustment for adjusting a distance between the bristles on said first channel and the bristles on said second channel, thereby adjusting batting resistance.

7. The apparatus of claim 5, wherein said channel support defines a batting swing path leading into the bristles.

8. The apparatus of claim 5, wherein said channel support comprises a metal bar.

9. The apparatus of claim 5, further comprising a pad, covering at least a portion of said channel support.

10. The apparatus of claim 5, wherein said bristles are removably affixed in said first and second channels.

11. The apparatus of claim 5, wherein said height adjustment comprises a pin insertable through a hole proximate to a top portion of said external post into one of a series of spaced apart holes in said internal post.

12. The apparatus of claim 5, wherein said base further comprises at least one wheel proximate to one end of said base and a handle proximate to an opposite end of said base, thereby allowing said apparatus to be rolled on and off a baseball field.

13. The apparatus of claim 6, wherein said resistance adjustment comprises at least one U-bolt connecting said second channel to said channel support that can be raised or lowered to adjust the distance between the bristles of said first and second channels.

14. The apparatus of claim 6, wherein said resistance adjustment comprises a pair of U-bolts adjustably securing said second channel to said channel support.

* * * * *